United States Patent [19]

Linke et al.

[11] 4,389,072

[45] Jun. 21, 1983

[54] LONGWALL MINERAL MINING INSTALLATION

[75] Inventors: Horst Linke; Helmut Erwien, both of Lunen; Herbert Beyer, Werne; Bodo Kerklies, Lunen; Bernhard Wleklinski, Werne; Rüdolf Mainüsch, Bergk-Oberaden; Dieter Grundken, Lunen; Bernd Kumor, Lunen; Ulrich Mohn, Lunen, all of Fed. Rep. of Germany

[73] Assignee: Gewerkschaft Eisenhutte Westfalia, Lunen, Fed. Rep. of Germany

[21] Appl. No.: 257,033

[22] Filed: Apr. 24, 1981

[30] Foreign Application Priority Data

May 3, 1980 [DE] Fed. Rep. of Germany ..... 3017046

[51] Int. Cl.[3] ..... E21C 29/02

[52] U.S. Cl. ..... 299/32; 299/43

[58] Field of Search ..... 299/31–34, 299/43, 64, 67, 18; 198/309, 735

[56] References Cited

U.S. PATENT DOCUMENTS 3,504,944 4/1970 Holz et al. ..... 299/43 X 4,176,884 12/1979 Erwien et al. ..... 299/43 X

FOREIGN PATENT DOCUMENTS 936869 9/1963 United Kingdom ..... 299/18

1384543 2/1975 United Kingdom ..... 299/43

*Primary Examiner*—Ernest R. Purser

*Attorney, Agent, or Firm*—Sughrue, Mion, Zinn, Macpeak and Seas

[57] ABSTRACT

A mineral mining installation comprises a longwall conveyor, a plough movable to and fro along a guide fixed to the face side of the longwall conveyor, and a drive station at one end of the longwall conveyor. The drive station includes a drive frame supporting drive means for driving the longwall conveyor. A support beam is provided at the goaf side of the drive station. The support beam extends substantially parallel to the drive frame. A floor plate extends beneath the drive frame. The goaf-side end portion of the floor plate is supported on the support beam by means of a lifting device, whereby the goaf-side end portion of the floor plate can be moved up and down relative to the support beam by the lifting device.

36 Claims, 5 Drawing Figures

LONGWALL MINERAL MINING INSTALLATION

BACKGROUND OF THE INVENTION

This invention relates to a longwall mineral mining installation.

A typical longwall mineral mining installation has a longwall scraper-chain conveyor. A plough is reciprocable along a guide provided at the face side of the conveyor. Both the conveyor and the plough are driven by drive stations provided at the ends of the conveyor. The drive stations each have a drive frame provided with separate drives for the conveyor and the plough, these drives being positioned at the goaf sides of their drive frames. Each drive station may be provided with a support beam which extends substantially parallel to its drive frame. Each support beam is attached to a floor plate fastened to the base of the associated drive frame.

U.S. Pat. No. 3,504,999 describes an installation of this type, each support beam of the installation being attached rigidly to its associated drive frame, thereby constituting a bracing girder which acts as an abutment for tensioning rams used to tension the longwall conveyor in the longitudinal direction. The plough drive and the conveyor drive of each drive station are positioned between the associated support beam and the conveyor. The face-side plough guide extends to the ends of the drive frames, so that material can be won along the entire length of the installation. The main disadvantage of this type of installation is that it is extremely difficult to reposition the drive stations to adapt the installation to different seam conditions. In particular, difficulties arise where the entire conveyor (including the drive stations) has to be tilted to alter the cutting horizon of the plough.

The aim of the invention is to provide a longwall mineral mining installation which overcomes this disadvantage.

SUMMARY OF THE INVENTION

The present invention provides a mineral mining installation comprising a longwall conveyor, a winning machine movable to and fro along the face side of the longwall conveyor, a drive station at one end of the longwall conveyor, the drive station including a drive frame supporting drive means for driving the longwall conveyor, a support beam at the goaf side of the drive station, the support beam extending substantially parallel to the drive frame, and a floor plate extending beneath the drive frame, wherein one portion of the floor plate is supported on the support beam by means of a lifting device, whereby said one portion of the floor plate can be moved up and down relative to the support beam by the lifting device.

Advantageously, the drive frame supports drive means for driving the winning machine. With the aid of the lifting device, it is possible to stabilise the extraordinarily heavy drive station. In particular, the very large loads, which usually result from the weight of the conveyor and winning machine drives, acting solely on the goaf side of the drive frame, are now partially supported by the lifting device. Moreover, the lifting device can be used to tilt the floor plate (and hence the entire drive station) to adjust the cutting horizon of the winning machine. This tilting is facilitated if said one portion of the floor plate is the goaf-side end portion thereof. The support beam also constitutes a stable abutment, against which the drive station advance mechanism can act.

Conveniently, the drive frame is rigidly attached to the floor plate.

Preferably, the winning machine is a plough which is movable to and fro along a guide attached to the face side of the longwall conveyor. In this case, the guide can extend the full length of the longwall face, so that the plough can win the entire length of the face in one working run.

Longwall mineral mining installations usually have a drive station at the delivery end of the longwall conveyor. Such an installation frequently also has a drive station at the other end of the longwall conveyor. Where the installation has two drive stations, it is conventional to call the drive station at the delivery end of the conveyor the main drive station, and to call the other drive station the auxiliary drive station. Obviously, each of the drive stations of such an installation could be associated with a respective support beam, floor plate and lifting device combination as defined above.

Advantageously, the lifting device comprises at least one hydraulic lifting ram, the or each hydraulic lifting ram being supported on the support beam and acting on an upwardly-extending support part of the floor plate. Preferably, the lifting device is provided with at least one telescopic guide, the or each telescopic guide being arranged between the support beam and the support part of the floor plate, and the or each telescopic guide being parallel to the or each hydraulic lifting ram. The telescopic guide(s) help to stabilise the floor plate, and prevent transverse forces stressing the hydraulic ram(s).

Conveneintly, the support beam has a ramp-like surface which slopes down towards the drive station.

The installation may further comprise a plurality of roof support units positioned side-by-side along the goaf side of the longwall conveyor and along the goaf side of the drive station, each of the roof support units being provided with an advance mechanism, wherein the advance mechanisms of the roof support units positioned on the goaf side of the drive station are connected to the goaf side of the support beam. In this case, the longwall conveyor is provided with a plurality of additional lifting devices, the additional lifting devices being distributed over the length of the longwall conveyor at one side thereof, the additional lifting devices being effective to tilt the longwall conveyor and thereby adjust the cutting horizon of the winning machine.

Where the drive station is a main drive station (that is to say it is at the delivery end of the longwall conveyor), one end of the support beam may be connected to said portion of the floor plate by the lifting device, the other end of the support beam being connected to the longwall conveyor by means of a support arm. By pivotally connecting the support arm to the longwall conveyor, reliable support of the main drive station is ensured. Moreover, the winning machine drive means may be attached to the drive frame, and be positioned between the support beam and the longwall conveyor. In this way, the winning machine drive means can be arranged to lie parallel with the drive frame. Where the winning machine is a plough, it may be driven, via an endless chain, by a sprocket wheel rotatably supported on the face side of the drive frame, the sprocket wheel being driven by the winning machine drive means by a drive shaft which passes through the drive frame.

Where the drive station is a main drive station, the installation may further comprise a roadway conveyor extending substantially at right-angles to the longwall conveyor, and a floor trough plate positioned at the end of the drive frame and attached to the floor plate, the floor trough plate supporting and receiving a section of the roadway conveyor. Advantageously, the roadway conveyor is fixed within the floor trough plate by means of fastening devices; and the floor trough plate is pivotally attached to the floor plate. Preferably, the drive frame is constituted by two side plates rigidly connected together, the goaf-side side plate being longer than the face-side side plate and extending beyond the roadway conveyor, and wherein the longwall conveyor drive means is attached to the extended portion of the goaf-side side plate. This enables the longwall conveyor drive means to be positioned in the roadway at the delivery end of the installation.

Where the drive station is a main drive station, the floor plate may be trough-shaped and the installation may also further comprise a fines conveyor which extends beneath the drive frame and is supported by the trough-shaped floor plate, the fines conveyor extending transversely with respect to the longwall conveyor, and having its delivery end disposed to discharge won material onto the roadway conveyor. Advantageously, the drive frame, the fines conveyor and the roadway conveyor are connected together to form a composite unit. This enables these parts to be advanced as a single unit. Preferably, the guide extends substantially to the fines conveyor, and wherein the guide is provided, at one side, with a loading ramp over which the plough can push won material onto the fines conveyor. The installation may further comprise a connector trough which is pivotally attached to the face side of the trough-shaped floor plate, the connector trough receiving and supporting the fines conveyor. A roof support may be positioned at the face side of the drive frame, the roof support being attached to the fines conveyor or the connector trough.

Where the drive station is an auxiliary drive station (that is to say it is at the end of the longwall conveyor opposite to its delivery end), the winning machine drive means and the longwall conveyor drive means may be positioned side-by-side between the support beam and the drive frame. Thus, both drive means can be arranged parallel to the drive frame. Advantageously, the longwall conveyor drive means is attached directly to the drive frame, and wherein the winning machine drive means is attached to an intermediate box-like member attached to the drive frame. Preferably, where the winning machine is a plough, it is driven, via an endless chain, by a sprocket wheel rotatably supported on the face side of the drive frame, the sprocket wheel being driven by the winning machine drive means by a drive shaft which passes through the drive frame and through the intermediate box-like member.

Where the drive station is an auxiliary drive station, one end of the support beam may be attached to the longwall conveyor by means of a first support arm, the other end of the support beam being connected to the drive frame by a second support arm. In this case, the first support arm may be rigidly attached to the longwall conveyor, and the second support arm may be rigidly attached to the drive frame. Moreover, each of the support arms may be pivotally attached to the support beam by means of a respective pin-and-slot pivot joint, the slots of the pivot joints being elongate and generally vertical, so that the joints have a predetermined degree of vertical play; and the floor plate may be pivotally attached to the support beam by means of pin-and-slot pivot joints, the slots of the pivot joints being elongate and generally vertical, so that the pivot joints have a predetermined degree of vertical play. These pivot joints enable the necessary lifting movements to be carried out with the support beam supported firmly on the mine floor.

Where the drive station is an auxiliary drive station, the installation may further comprise an additional lifting device, the additional lifting device being provided with a floor skid and being attached to the intermediate box-like member.

For an auxiliary drive station installation, a curved conveyor may be positioned in the region of the drive station, the curved conveyor being connected to the drive station to form a composite unit, the delivery end of the curved conveyor being aligned with the longwall conveyor and being positioned above the drive frame, the other end of the curved conveyor being positioned on the face side of the longwall conveyor. Advantageously, the curved conveyor is provided with a sprocket drum and drive means at said other end thereof, and wherein the sprocket drum is provided with cutter bits. These cutter bits can take up any loose mineral material lying in the adjacent roadway/longwall working junction during drive station advance. Preferably, the curved conveyor is provided with a loading ramp on that side remote from the support beam.

The invention also provides a mineral mining installation comprising a longwall conveyor, a winning machine movable to and fro along the face side of longwall conveyor, a drive station at each end of the longwall conveyor, each drive station including a drive frame supporting drive means for driving the longwall conveyor, a respective support beam being provided at the goaf side of each drive station, each support beam extending substantially parallel to the respective drive frame, and a respective floor plate extending beneath each drive frame, wherein one portion of each floor plate is supported on the respective support beam by means of a respective lifting device, whereby said one portion of each floor plate can be moved up and down relative to the respective support beam by the respective lifting device. In this case, one drive station is a main drive station, and has the features defined above, and the other drive station is an auxiliary drive station and has the features defined above.

The invention further provides a mineral mining installation comprising a longwall conveyor, a winning machine movable to and fro along the face side of the longwall conveyor, a drive station at one end of the longwall conveyor, the drive station including a drive frame supporting drive means for driving the longwall conveyor, a trough-shaped floor plate extending beneath the drive frame, and a fines conveyor which extends beneath the drive frame and is supported by the trough-shaped floor plate, the fines conveyor extending transversely with respect to the longwall conveyor, and having its delivery end disposed to discharge won material onto a roadway conveyor.

BRIEF DESCRIPTION OF THE DRAWINGS

A longwall mineral mining installation constructed in accordance with the invention will now be described, by way of example, with reference to the accompanying drawings, in which.

DESCRIPTION OF PREFERRED EMBODIMENT

Figure 1:
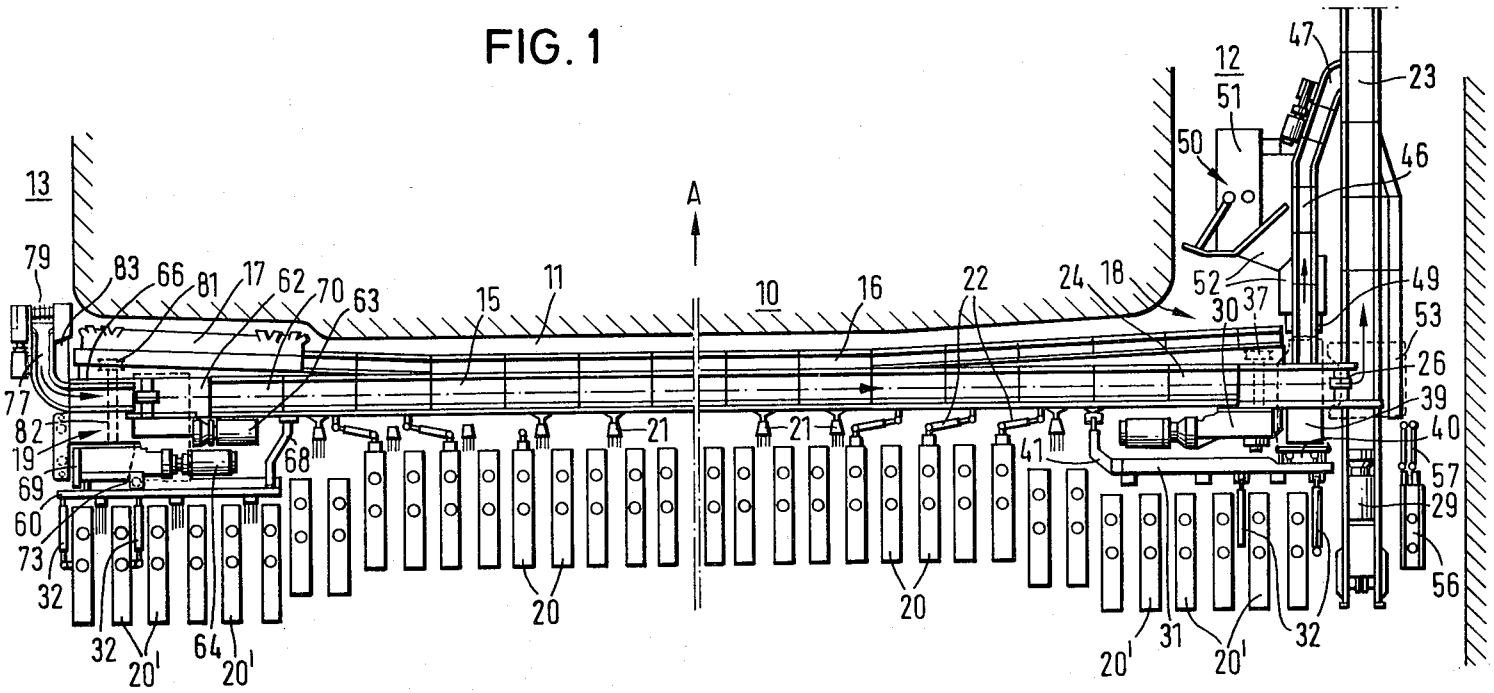
FIG. 1 is a plan view of the installation.

Referring to the drawings, FIG. 1 shows a longwall face 10, a longwall working 11, and lower and upper roadways 12 and 13 respectively. A scraper-chain conveyor 15 is provided in the longwall working 11, the conveyor extending along the working adjacent to the face 10. A plough guide 16 is attached to the face side of the conveyor 15.. A plough 17 is drivable, by means of an endless chain (not shown), to and fro along the guide 16. A main drive station 18 is provided in the roadway 12, and an auxiliary drive station 19 is provided at the other end of the working 11 adjacent to the roadway 13, the two drive stations being arranged to drive both the conveyor 15 and the plough 17, as is described below.

The roof of the longwall working 11 is supported by a roof support assembly constituted by a plurality of advanceable roof support units 20. The roof support units 20 are positioned side-by-side along the goaf side of the conveyor 15, and are attached to the conveyor by means of respective guide and advance mechanisms 21. The mechanisms 21 are used to advance the conveyor 15 in the direction A of face advance, the roof support units 20 then being advanced in a follow-up movement by the mechanisms 21. Where the longwall working 11 is inclined (for example from the upper roadway 13 down to the lower roadway 12), the conveyor 15 is tensioned longitudinally by means of hydraulic bracing rams 22. The bracing rams 22, which are positioned in at least the end zones of the conveyor 15, are articulatedly connected between the conveyor and individual roof support units 20.

In the region of the auxiliary drive station 19, the plough guide 16 extends approximately to the junction between the longwall working and the upper roadway 13. In the region of the main drive station 18, however, the plough guide 16 extends into the lower roadway 12. The mineral material won by the plough 17 is conveyed along the conveyor 15, and is discharged, at the main drive station 18, onto a roadway conveyor 23. The conveyor 23, which is also a scraper-chain conveyor, discharges the won material onto a further conveyor (not shown).

The main drive station 18 has a drive frame 25, which is connected to the pans (channel sections) of the conveyor 15 by means of an adaptor pan 24. The drive frame 25, which has a pair of side plates 27 and 28 rigidly connected together, supports a rotatable sprocket drum 26 for driving (and reversing) the endless chain (not shown) of the scraper-chain assembly of the conveyor 15. The sprocket drum 26 is mounted between the two side plates 27 and 28. The goaf-side side plate 27 is longer than the face-side side plate 28, so as to extend further into the roadway 12. A conveyor drive 29, constituted by a drive motor and gearing, is flanged to the extended portion of the side plate 27. The conveyor drive 29 is arranged to drive the sprocket drum 26. The conveyor drive 29, which lies at right-angles to the conveyor 15, thus stands in the roadway 12 "upstream" of the conveyor 23.

Figure 2:
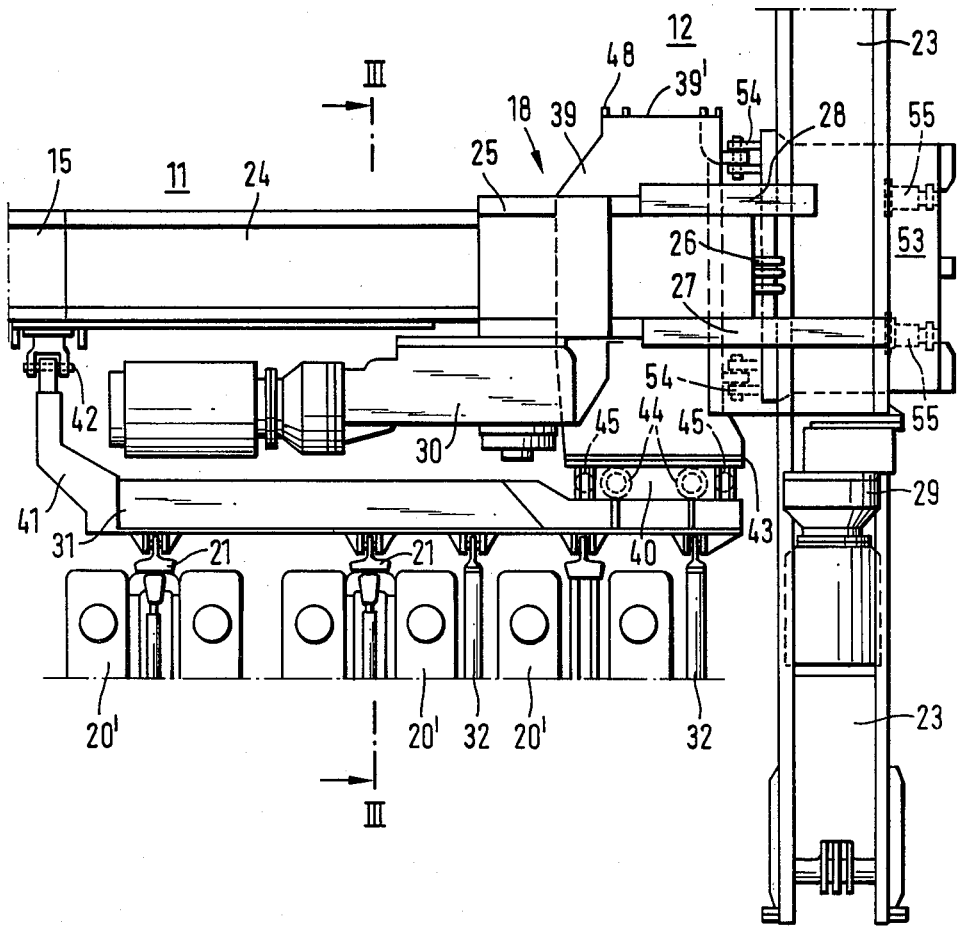
FIG. 2 is a plan view, on a larger scale, of one end portion of the installation of FIG. 1, parts of the installation having been omitted for the sake of clarity.

A plough drive 30, which is also constituted by a drive motor and gearing, is flanged to the side plate 27 so as to lie parallel to the conveyor 15. The plough drive 30 is positioned between the drive frame 25 and a support beam 31, which rests on the mine floor. The advance mechanisms 21 (see FIG. 2) of the three hydraulic roof support units 20', which support the mine roof in this region, are attached to the goaf side of the support beam 31 rather than to the conveyor 15. The end roof support unit 20' (that is to say the lowest roof support unit) is provided with two additional advance mechanisms 32. These advance mechanisms 32 not only serve to prevent the end roof support unit 20' from slipping down the incline, but also help with the advance movement of the heavy main drive station 18.

Figure 3:
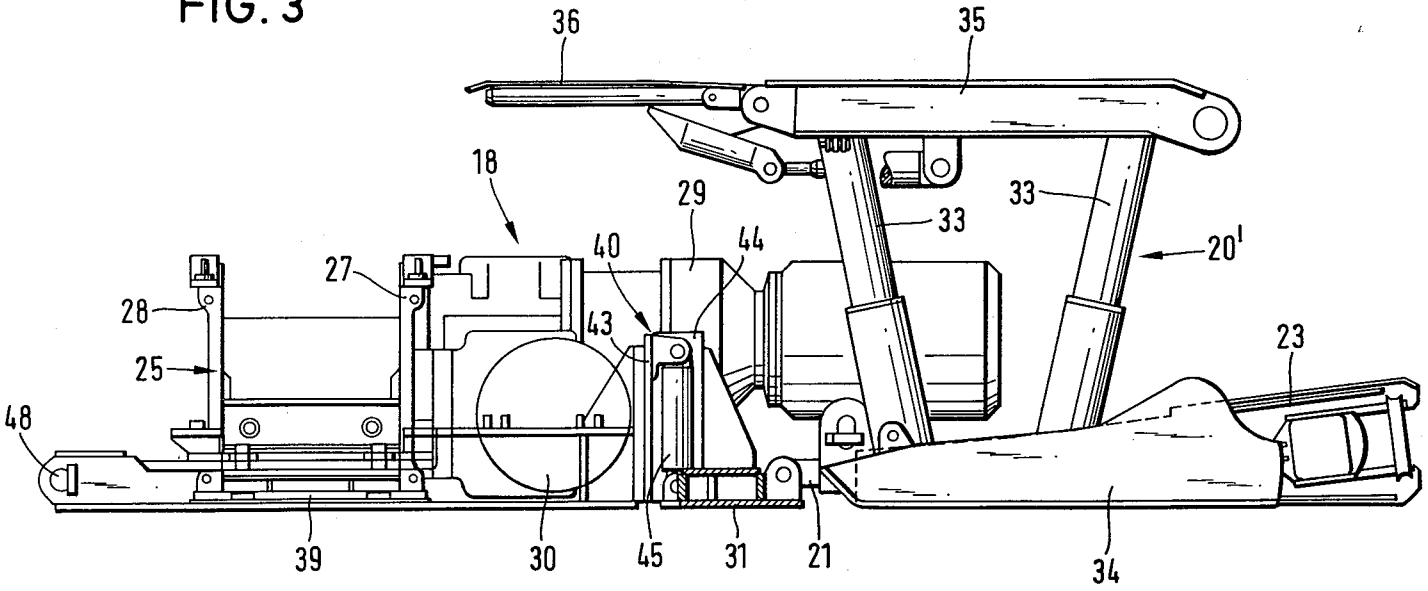
FIG. 3 is a cross-section taken on the line III—III of FIG. 2.

As best seen in FIG. 3, each of the roof support units 20' has a roof bar 35 supported on a floor sill 34 by means of hydraulic props 33. The roof bar 35 is provided with an advanceable forward extension 36 for supporting the mine roof in the region above the main drive station 18. The roof support units 20 are basically the same as the roof support units 20', except that they do not have the forward extensions 36.

In the region of the main drive station 18, the plough guide 16 is angled slightly away from the conveyor 15 and towards the face 10. THis angling of the plough guide 16 forms a space for accommodating a sprocket wheel 37, which drives the endless plough drive chain. The plough drive sprocket wheel 37 is drivably connected to the plough drive 30 by means of a shaft 38, which passes through the drive frame 25, and is connected to the output shaft (not shown) of the plough drive.

The entire drive frame 25, together with the drives 29 and 30 which are attached thereto, rests on a stable floor plate 39. The drive frame 25 is firmly attached to the floor plate 39, by for example bolts (not shown). The floor plate 39 protrudes beyond the drive frame 25 on both the goaf side and the face side thereof (see FIG. 2). On the goaf side, the floor plate 39 is attacched to the roadway end of the support beam 31 by means of a lifting device 40. At its other end, the support beam 31 carries a rigid arm 41 which is pivotally attached, at a pivot joint 42, to the conveyor 15 in the transition zone between the adaptor pan 24 and the adjacent pan of the conveyor. The pivot axis of the joint 42 lies parallel to the longitudinal axis of the conveyor 15.

The lifting device 40 is interposed between the support beam 31 and an upwardly-extending support flange 43 attached to, or forming part of, the goaf side of the floor plate 39. The lifting device 40 comprises a pair of upright telescopic guides 44, and a pair of upright hydraulic lifting rams 45. The rams 45 are articulatedly connected between the support beam 31 and the upper end of the support flange 43. By supplying the rams 45 with pressurised hydraulic fluid, so as to extend the rams, the floor plate 39 will tilt upwardly about its face-side edge 39', whereby the main drive station 18 and the adaptor pan 24 are also tilted. The joint 42 permits this tilting to occur. The rams 45 provide support for the goaf side of the drive frame 25, so that the position of the entire drive station 18 is stabilised.

The floor plate 39 is trough-shaped, so as to accommodate a fines conveyor 46, which extends underneath the drive frame 25. The fines conveyor 46 extends transversely to the longwall conveyor 15, and its delivery end 47 is raised and angled off so that it can discharge the fines onto the roadway conveyor 23. The other end of the fines conveyor 46 lies between the drive frame 25 and the support beam 31. The fines conveyor 46 is attached to the main drive station 18, and to the roadway conveyor 23, to form a composite unit. A connector trough 49 (see FIG. 1) is pivotally attached, by means of an articulated joint 48 (see FIG. 2), to the face-side edge 39' of the floor plate 39. The connector trough 49 accommodates the end portion of the fines conveyor 46. The articulated joint 48 prevents the connector trough 49 (and hence the fines conveyor 46) tilting with the drive frame 25 under the action of the lifting device 40. The fines conveyor 46 is also a scraper-chain conveyor. Any won material conveyed along the upper (conveying) run of the longwall conveyor 15 and entrained by the scrapers, as they run round the sprocket drum 26 into the lower (return) run, drops onto the fines conveyor 46, and is subsequently discharged, at 47, onto the roadway conveyor 23.

The fines conveyor 46 is provided with an auxiliary advance mechanism 50 for assisting with the advance of the composite unit constituted by the main drive station 18, the roadway conveyor 23 and the fines conveyor. The auxiliary advance mechanism 50 thus has at least one hydraulic advance ram (not shown). The mechanism 50 also has a roof bar supported on a floor sill by means of hydraulic props (none of which are shown), and so constitutes a roof support. A central control unit 51, for controlling the entire longwall installation, is provided on the mechanism 50 within the protection afforded by the hydraulically supported roof bar.

A loading ram 52 is provided on the longwall side of the fines conveyor 46 (or on its connector trough 49). The plough 17 pushes won material directly onto the fines conveyor 46, via the ramp 52, as it nears the end of its movement towards the roadway 12. The connector trough 49 is vertically movable, and is articulated to the auxiliary advance mechanism 50, so that the fines conveyor 46 can adapt itself to irregularities in the floor of the roadway 12, and to the relative dispositions of the conveyors 15 and 23.

A floor trough plate 53 is positioned at the roadway side of the drive frame 25, the floor trough plate being pivotally connected to the floor plate 39 by means of pivot joints 54. The floor trough plate 53 accommodates the input end portion of the roadway conveyor 23. The joints 54 are arranged with their pivot axes perpendicular to the face 10, so that the floor trough plate 53 (and hence the roadway conveyor 23) does not participate in the tilting movement of the floor plate 39. Thus, the floor trough plate 53 can adapt itself to irregularities in the floor of the roadway 12. The roadway conveyor 23 is made fast with respect to the floor trough plate 53 by means of clamps 55. These clamps 55 prevent the roadway conveyor 23 from moving longitudinally or vertically with respect to the floor trough plate 53.

A roof support 56 (see FIG. 1) is provided adjacent to the conveyor drive 29, the roof support 56 serving to secure the roof in the end region of the installation. The roof support 56 is attached to the floor trough plate 53 by means of at least one hydraulic advance ram 57.

Figure 4:
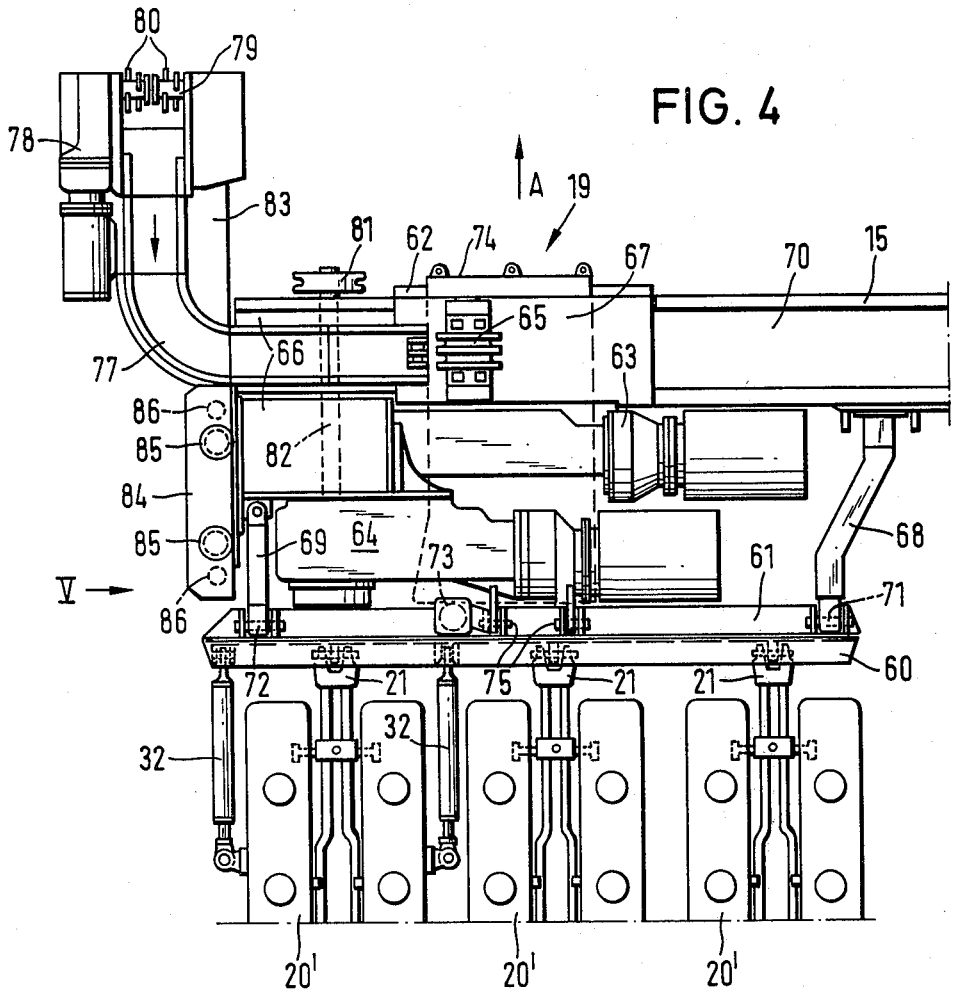
FIG. 4 is a plan view, on a larger scale, of the other end portion of the installation of FIG. 1.
Figure 5:
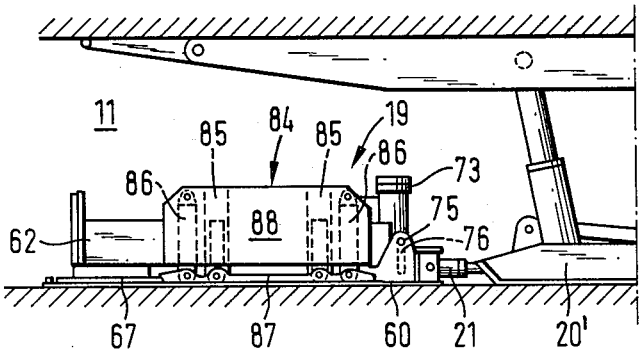
FIG. 5 is an elevation looking in the direction of the arrow V shown in FIG. 4.

Referring now to FIGS. 1, 4 and 5, the auxiliary drive station 19 has a drive frame 62 and a support beam 60, which lies on the floor of the working 11 and parallel to the conveyor 15 on the goaf side thereof. The side 61 of the support beam 60 which faces the drive station 19 slopes to form a ramp, so that fines cannot build up in front of the support beam 60. As was the case with the main drive station 18, the advance mechanisms 21 of the three roof support units 20', which support the mine roof in the region of the auxiliary drive station 19, are attached to the goaf side of the support beam 60. Moreover, the end unit 20' is provided with two additional advance mechanisms 32.

The distance between the support beam 60 and the longwall conveyor 15 is greater than the distance between the support beam 31 and the longwall conveyor. This is because a conveyor drive 63 and a plough drive 64 need to be accommodated in this region. Thus, the conveyor drive 63 and the plough drive 64 are arranged because the support beam 60 and the drive frame 62, both drives lying parallel to the conveyor 15. The conveyor drive 63 is flanged directly onto the goaf-side side plate of the drive frame 62, and drives a sprocket drum 65 rotatably mounted within the drive frame. The sprocket drum 65 drives the endless chain of the scraper-chain assembly of the conveyor 15. The plough drive 64 is attached indirectly to the drive frame 62, with the interposition of a plough box 66. The gearbox (not shown) of the plough drive 64 is attached laterally to the plough box 66, which in turn is attached to the end portion of the drive frame 62. The plough drive 64 drives the plough drive chain, via a sprocket wheel 81 and a drive shaft 82 which passes through the drive frame 62 and the plough box 66.

The drive frame 62 of the auxiliary drive station 19 rests on a stable floor plate 67. The drive frame 62 is firmly attached to the floor plate 67, by for example bolts (not shown). The opposite ends of the support beam 60 are attached to the longwall installation by respective arms 68 and 69. The arm 68 is rigidly fixed to an adaptor pan 70 (which connects the auxiliary drive station 19 to the conveyor pans), and is pivotally attached to the support beam 60 by means of a pivot joint 71. The pivot joint 71 has a pin which engages within vertical elongate slots, so that the joint has a predetermined degree of vertical play. The arm 69 is rigidly fixed to the plough box 66, and is pivotally attached to the support beam 60 by means of a pivot joint 72. The pivot joint 72 is similar to the pivot joint 71. The floor plate 67 extends as far as the support beam 60, and is connected thereto by means of a lifting device 73. The lifting device 73 includes a hydraulic lifting ram (not shown) which bears on the support beam 60, and is pivotally attached to an upwardly-extending flange associated with the floor plate 67. By supplying the hydraulic lifting ram of the device 73 with pressurised hydraulic fluid, so as to extend the ram, the floor plate 67 will tilt upwardly about its face-side edge 74, whereby the auxiliary drive station 19 is also tilted. The floor plate 67 is attached to the support beam 60 by means of pivot joints 75. As with the pivot joints 71 and 72, the joints 75 have pins which engage within vertical elongate slots 76 (see FIG. 5), so that the tilting movement of the floor plate 67 is not transmitted to the support beam 60. A short, curved conveyor 77 is provided in the region of the auxiliary drive station 19. The conveyor 77 is also a scraper-chain conveyor, and extends from a sprocket drum 79 (which is driven by a conveyor drive 78), through an arc of about 90°, and terminates adjacent to the sprocket drum 65 of the longwall conveyor 15. The conveyor 77 rises as it approaches the drive frame 62, so that any material conveyed along the conveyor 77 can be transferred to the longwall conveyor 15 over its sprocket drum 65. The conveyor 77 is attached to the plough box 66, and so forms a composite unit with the auxiliary drive station 19. The sprocket drum 79 is provided with cutter bits 80 which, as the auxiliary drive station 19 is moved in the direction A of face advance, take up loose material lying in the roadway/working junction, the loosened material being lifted by the rotating drum 79 onto the conveyor 77.

As shown in FIG. 1, the plough guide 16 is angled slightly away from the conveyor 15 and towards the face 10. This angling of the plough guide 16 forms a space for accommodating the plough drive sprocket wheel 81. The curved conveyor 77 is provided with a loading ramp 83 on that side thereof adjacent to the longwall working 11. The ramp 83 is such that won material, pushed ahead of the plough 17 as it approaches the roadway 13, is lifted by the ramp 83 onto the conveyor 77, and fed by the latter onto the longwall conveyor 15.

The auxiliary drive station 19 is provided with a further lifting device 84, which is attached to the roadway end face of the plough box 66. The lifting device 84 comprises a pair of upright telescopic guides 85, and a pair of upright hydraulic lifting rams 86. The rams 86 are articulatedly connected between a floor skid 87 and a flange 88 (see FIG. 5) attached to the plough box 66. With the aid of the hydraulic lifting rams 86, which can be extended either individually or together, the entire auxiliary drive station 19 can be supported and tilted. The weight of the heavy drives 63 and 64 is, therefore, supported, via the lifting devices 73 and 84, on the support beam 60 and the floor skid 87 respectively. The entire auxiliary drive station 19 (plus the conveyor 77) can be advanced, in the direction A of face advance, by the advance mechanisms 21 and 32 of the roof support units 20'.

We claim:

1. A mineral mining installation comprising a longwall conveyor, a winning machine movable to and fro along the face side of the longwall conveyor, a drive station at one end of the longwall conveyor, the drive station including a drive frame supporting drive means for driving the longwall conveyor, a support beam at the goaf side of the drive station, the support beam extending substantially parallel to the drive frame, and a floor plate extending beneath the drive frame, wherein one portion of the floor plate is supported on the support beam by means of a lifting device, whereby said one portion of the floor plate can be moved up and down relative to the support beam by the lifting device.

2. An installation according to claim 1, wherein said one portion of the floor plate is an end portion of the floor plate.

3. An installation according to claim 1, wherein the drive frame is rigidly attached to the floor plate.

4. An installation according to claim 1, wherein the lifting device comprises at least one hydraulic lifting ram, said at least one hydraulic lifting ram being supported on the support beam and acting on an upwardly-extending support part of the floor plate.

5. An installation according to claim 4, wherein the lifting device is provided with at least one telescopic guide, said at least one telescopic guide being arranged between the support beam and the support part of the floor plate, and said at least one telescopic guide being parallel to said at least one hydraulic lifting ram.

6. An installation according to claim 1, wherein the support beam has a ramp-like surface which slopes down towards the drive station.

7. An installation according to claim 1, further comprising a plurality of roof support units positioned side-by-side along the goaf side of the longwall conveyor and along the goaf side of the drive station, each of the roof support units being provided with an advance mechanism, wherein the advance mechanisms of the roof support units positioned on the goaf side of the drive station are connected to the goaf side of the support beam.

8. An installation according to claim 1, wherein the longwall conveyor is provided with a plurality of additional lifting devices, the additional lifting devices being distributed over the length of the longwall conveyor at one side thereof, the additional lifting devices being effective to tilt the longwall conveyor and thereby adjust the cutting horizon of the winning machine.

9. An installation according to claim 1, wherein the drive frame supports drive means for driving the winning machine.

10. An installation according to claim 9, wherein the winning machine is a plough which is movable to and fro along a guide attached to the face side of the longwall conveyor.

11. An installation according to claim 10, wherein the drive station is provided at the delivery end of the longwall conveyor.

12. An installation according to claim 11, wherein one end of the support beam is connected to said portion of the floor plate by the lifting device, the other end of the support beam being connected to the longwall conveyor by means of a support arm.

13. An installation according to claim 11, wherein the plough drive means is attached to the drive frame and is positioned between the support beam and the longwall conveyor.

14. An installation according to claim 13, wherein the plough is driven, via an endless chain, by a sprocket wheel rotatably supported on the face side of the drive frame, the sprocket wheel being driven by the plough drive means by a drive shaft which passes through the drive frame.

15. An installation according to claim 11, further comprising a roadway conveyor extending substantially at right-angles to the longwall conveyor, and a floor trough plate positioned at the end of the drive frame and attached to the floor plate, the floor trough plate supporting and receiving a section of the roadway conveyor.

16. An installation according to claim 15, wherein the roadway conveyor is fixed within the floor trough plate by means of fastening devices.

17. An installation according to claim 15, wherein the floor trough plate is pivotally attached to the floor plate.

18. An installation according to claim 15, wherein the drive frame is constituted by two side plates rigidly connected together, the goaf-side side plate being longer than the face-side side plate and extending beyond the roadway conveyor, and wherein the longwall conveyor drive means is attached to the extended portion of the goaf-side side plate.

19. An installation according to claim 15, wherein the floor plate is trough-shaped, and the installation further comprises a fines conveyor which extends beneath the drive frame and is supported by the trough-shaped floor plate, the fines conveyor extending transversely with respect to the longwall conveyor, and having its delivery end disposed to discharge won material onto the roadway conveyor.

20. An installation according to claim 19, wherein the drive frame, the fines conveyor and the roadway conveyor are connected together to form a composite unit.

21. An installation according to claim 19, wherein the guide extends substantially to the fines conveyor, and wherein the guide is provided, at one side, with a loading ramp over which the plough can push won material onto the fines conveyor.

22. An installation according to claim 19, further comprising a connector trough which is pivotally attached to the face side of the trough-shaped floor plate, the connector trough receiving and supporting the fines conveyor.

23. An installation according to claim 19, further comprising a roof support positioned at the face side of the drive frame, the roof support being attached to the fines conveyor.

24. An installation according to claim 5, wherein the drive station is provided at the end of the longwall conveyor opposite to its delivery end.

25. An installation according to claim 24, wherein the plough drive means and the longwall conveyor drive means are positioned side-by-side between the support beam and the drive frame.

26. An installation according to claim 25, wherein the longwall conveyor drive means is attached directly to the drive frame, and wherein the plough drive means is attached to a plough box attached to the drive frame.

27. An installation according to claim 25, wherein the plough is driven, via an endless chain, by a sprocket wheel rotatably supported on the face side of the drive frame, the sprocket wheel being driven by the plough drive means by a drive shaft which passes through the drive frame and through the plough box.

28. An installation according to claim 24, wherein one end of the support beam is attached to the longwall conveyor by means of a first support arm, the other end of the support beam being connected to the drive frame by a second support arm.

29. An installation according to claim 28, wherein the first support arm is rigidly attached to the longwall conveyor, and the second support arm is rigidly attached to the drive frame.

30. An installation according to claim 28, wherein each of the support arms is pivotally attached to the support beam by means of a respective pin-and-slot pivot joint, the slots of the pivot joints being elongate and generally vertical, so that the joints have a predetermined degree of vertical play.

31. An installation according to claim 24, wherein the floor plate is pivotally attached to the support beam by means of pin-and-slot pivot joints, the slots of the pivot joints being elongate and generally vertical, so that the pivot joints have a predetermined degree of vertical play.

32. An installation according to claim 26, further comprising an additional lifting device, the additional lifting device being provided with a floor skid and being attached to the plough box.

33. An installation according to claim 24, further comprising a curved conveyor positioned in the region of the drive station, the curved conveyor being connected to the drive station to form a composite unit, the delivery end of the curved conveyor being aligned with the longwall conveyor and being positioned above the drive frame, the other end of the curved conveyor being positioned on the face side of the longwall conveyor.

34. An installation according to claim 33, wherein the curved conveyor is provided with a sprocket drum and drive means at said other end thereof, and wherein the sprocket drum is provided with cutter bits.

35. An installation according to claim 33, wherein the curved conveyor is provided with a loading ramp on that side remote from the support beam.

36. A mineral mining installation comprising a longwall conveyor, a winning machine movable to and fro along the face side of longwall conveyor, a drive station at each end of the longwall conveyor, each drive station including a drive frame supporting drive means for driving the longwall conveyor, a respective support beam being provided at the goaf side of each drive station, each support beam extending substantially parallel to the respective drive frame, and a respective floor plate extending beneath each drive frame, wherein one portion of each floor plate is supported on the respective support beam by means of a respective lifting device, whereby said one portion of each floor plate can be moved up and down relative to the respective support beam by the respective lifting device.

* * * * *